US006688393B2

(12) United States Patent
Sredensek et al.

(10) Patent No.: US 6,688,393 B2
(45) Date of Patent: Feb. 10, 2004

(54) DUAL JACKING SYSTEM AND METHOD

(75) Inventors: Eric M. Sredensek, Carrollton, TX (US); Michael S. Oser, Plano, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 55 days.

(21) Appl. No.: 10/082,409

(22) Filed: Feb. 25, 2002

(65) Prior Publication Data

US 2003/0159833 A1 Aug. 28, 2003

(51) Int. Cl.[7] ..... E21B 19/18
(52) U.S. Cl. ..... 166/377; 166/380; 166/77.35
(58) Field of Search ..... 166/377, 378, 166/380, 381, 77.51, 77.52, 77.53, 85.1

(56) References Cited

U.S. PATENT DOCUMENTS 4,367,056 A * 1/1983 Seneviratne ..... 405/228
4,405,115 A * 9/1983 Boyadjieff ..... 254/106
4,591,007 A 5/1986 Shaginian et al. ..... 175/85
4,951,759 A 8/1990 Richardson ..... 175/85
5,122,023 A 6/1992 Mochizuki ..... 414/22.61
5,351,767 A 10/1994 Stogner et al. ..... 175/162
5,931,238 A 8/1999 Gilmore et al. ..... 175/52
6,158,516 A * 12/2000 Smith et al. ..... 166/385
6,234,353 B1 5/2001 Light ..... 166/377
6,298,927 B1 10/2001 Back ..... 175/52
6,343,892 B1 2/2002 Kristiansen ..... 405/195.1
6,386,284 B1 * 5/2002 Buck et al. ..... 166/77.53

* cited by examiner

*Primary Examiner*—William Neuder
(74) *Attorney, Agent, or Firm*—John W. Wustenberg; Warren B. Kice

(57) ABSTRACT

This invention relates to a dual jacking system and method for inserting and extracting tubulars, or the like into and out of a well, such as an oil or gas well, at a relatively high rate of speed.

24 Claims, 9 Drawing Sheets

DUAL JACKING SYSTEM AND METHOD

BACKGROUND

This invention relates to a dual jacking system and method for inserting and extracting tubulars, or the like, into and out of a well, such as an oil or gas well, at a relatively high rate of speed.

In oil and gas well operations, long strings of tubulars, such as pipes, are inserted into and removed from wells at various times. When tubulars are inserted into a well, a tubular is attached to the top of a tubular string and the string is lowered into the well. When tubulars are removed from a well, a tubular is removed from the top of a tubular string and the string is raised from the well. Depending on the depth of a well, a string of tubulars may be thousands of feet long and many tubulars will need to be attached to or removed from the string to complete an operation. As a result, operations where a tubular string is inserted into a well and operations where a tubular string is removed from a well may take a relatively long time and require substantial man hours to complete.

It would be desirable to be able to reduce the amount of time and man hours it takes to insert tubulars into or removal tubulars from an oil or gas well. Accordingly, a dual jacking system and method as described herein is needed.

DETAILED DESCRIPTION

Figure 1:
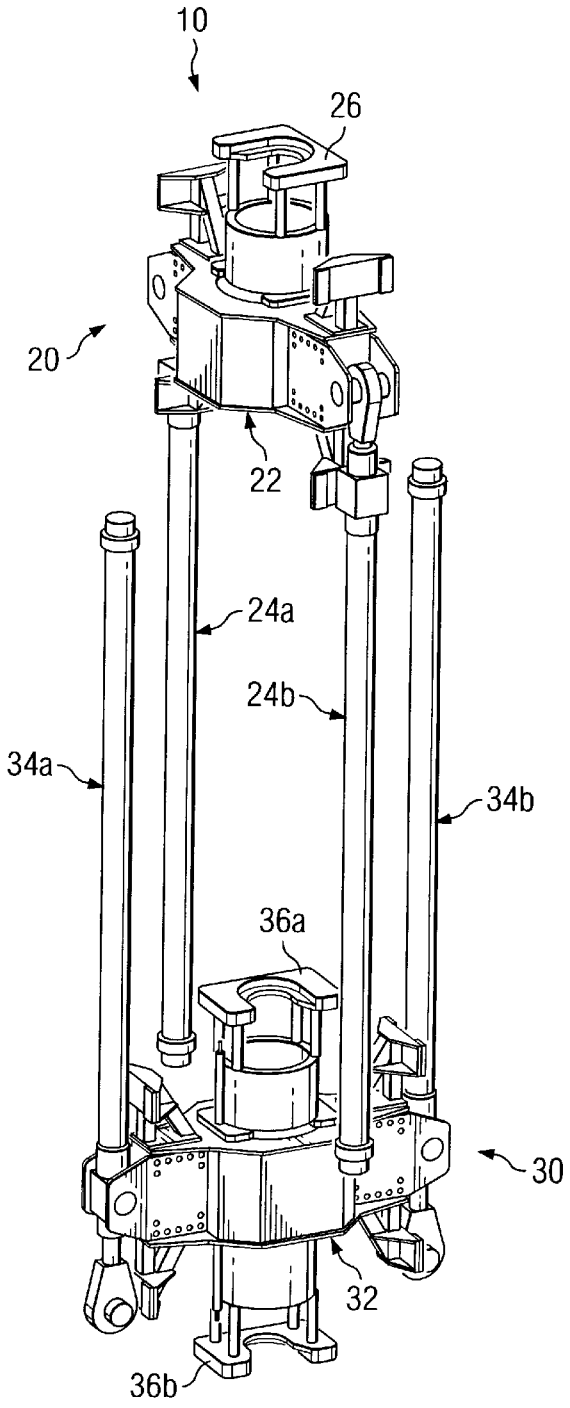
FIG. 1 is an isometric view illustrating an embodiment of a dual jacking system shown in a first operational mode.

Referring to FIG. 1 of the drawings, the reference numeral 10 refers, in general, to a dual reciprocating mechanism, also referred to herein as a system, according to an embodiment. The system 10 includes an upper jack 20 including a head 22 to which one end of each of a pair of hydraulic cylinders 24*a* and 24*b* are connected in a manner to be described. The hydraulic cylinders 24*a* and 24*b* operate in a conventional manner to reciprocate the head 22 in a vertical direction, as viewed in FIG. 1. The head 22 includes an engaging and disengaging unit, in the form of a slip bowl 26, adapted to engage and release a tubular (not shown). Details of the head 22 and the slip bowl 26 will be described later.

A lower jack 30 extends in a vertically spaced relation to the upper jack 20 and includes a traveling head 32 to which one end of each of a pair of hydraulic cylinders 34*a* and 34*b* are connected, in a manner to be described. The hydraulic cylinders 34*a* and 34*b* operate in a conventional manner to reciprocate the traveling head 32 in a vertical direction, as viewed in FIG. 1. The traveling head 32 includes vertically spaced engaging and disengaging units, in the form of a slip bowl 36*a* and an inverted slip bowl 36*b*, for engaging and releasing a tubular (not shown). Each of the slip bowls 26, 36*a*, and 36*b* is independently operable to engage or release a tubular at a given time and, since conventional, will not be described in additional detail.

Figure 2:
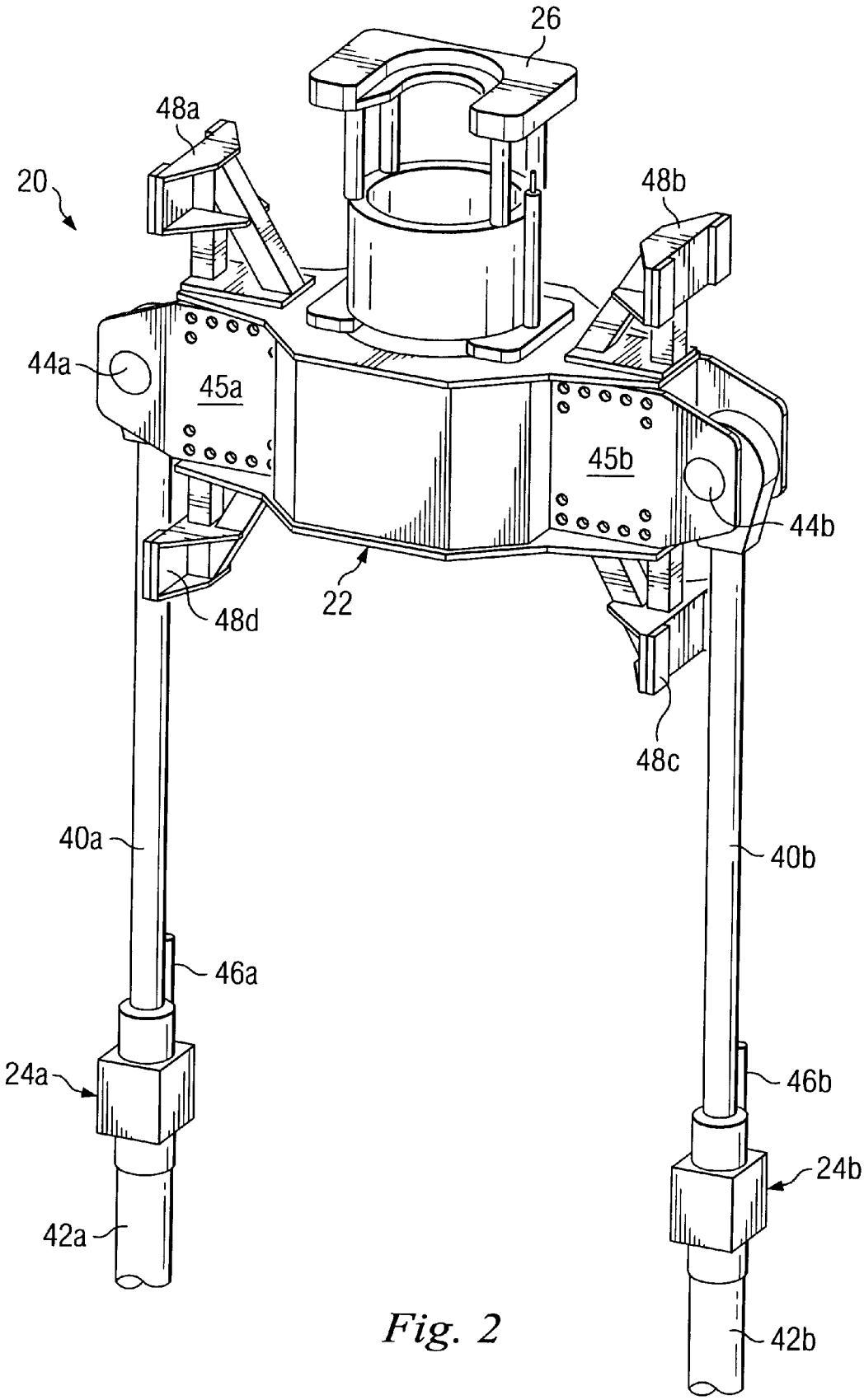
FIG. 2 is an enlarged isometric view of a portion of the system of FIG. 1.

Referring to FIG. 2 of the drawings, the hydraulic cylinders 24*a* and 24*b* of the upper jack 20 extend vertically as viewed in the drawing, and include two rods 40*a* and 40*b*, respectively, which move between a retracted and extended position relative to two barrels 42*a* and 42*b*, respectively, in a conventional manner. The respective upper ends of the rods 40*a* and 40*b* connect to two pins 44*a* and 44*b*, respectively, which are mounted between two sets of flanges 45*a* and 45*b*, respectively, on opposing sides of the head 22 to allow rotational movement between the head 22 and the hydraulic cylinders 24*a* and 24*b*.

Linear position transducers 46*a* and 46*b* are attached to the hydraulic cylinders 24*a* and 24*b*, respectively, for detecting and tracking the position of the upper jack 20. The use of the linear position transducers 46*a* and 46*b* will be described in additional detail below. The head 22 includes guides 48*a* and 48*b* mounted on an upper portion of the head 22 and guides 48*c* and 48*d* mounted on a lower portion of the head 22. The function of the guides 48*a*, 48*b*, 48*c*, and 48*d* will be described in additional detail below.

Figure 3:
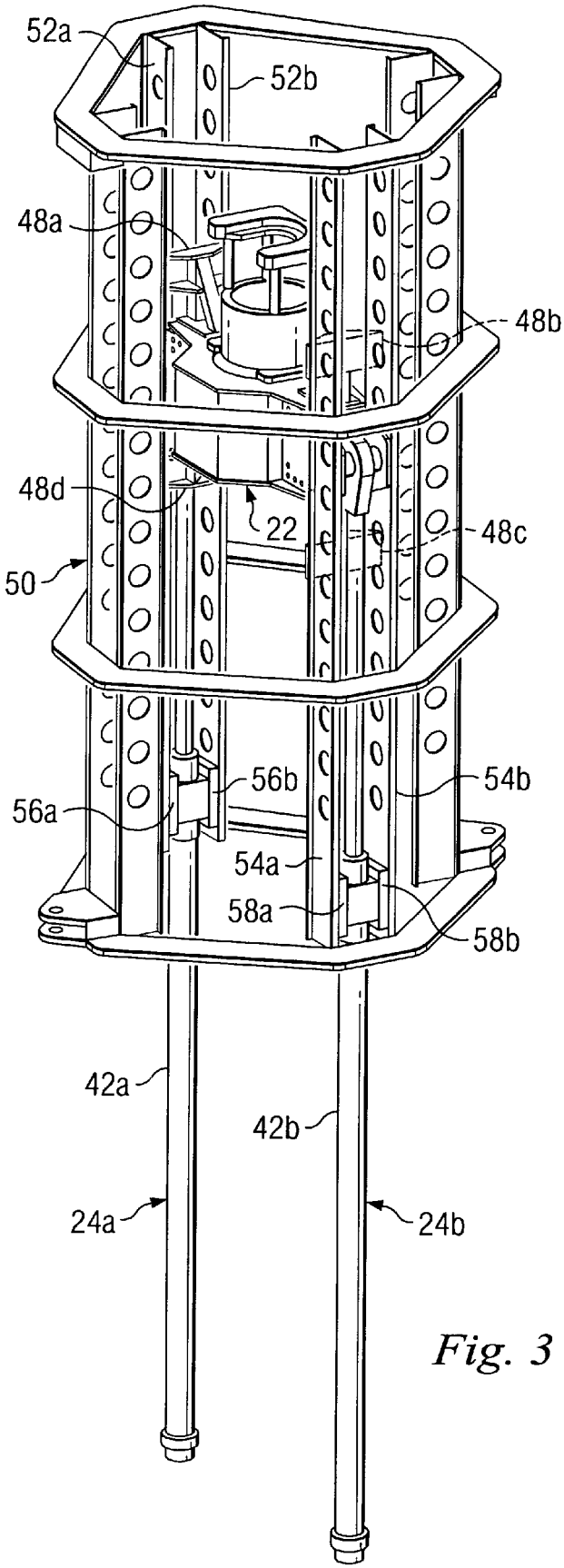
FIG. 3 is an isometric view of the portion of FIG. 2 shown located in the upper section of a tower.

FIG. 3 depicts the upper jack 20 located in an upper tower section 50 which is formed by a plurality of vertical and horizontal structural members in a conventional manner. The upper tower section 50 includes two vertically spaced, opposed rails 52*a* and 52*b* as well as two vertically spaced, opposed rails 54*a* and 54*b* spaced from the rails 52*a* and 52*b*. Each of the guides 48*a* and 48*d* of the upper jack 20 extend between the rails 52*a* and 52*b* in engagement therewith; and each of the guides 48*b* and 48*c* extend between the rails 54*a* and 54*b*, in engagement therewith to permit vertical movement of the head 22 relative to the upper tower section 50.

The hydraulic cylinder 24*a* is mounted between the rails 52*a* and 52*b* and the upper end of the barrel 42*a* attaches to the rail 52*a* at a point 56*a*, and to the rail 52*b* at a point 56*b*. The hydraulic cylinder 24*b* is mounted between the rails 54*a* and 54*b* and an upper end of the barrel 42*b* is attached to the rail 54*a* at a point 58*a* and attaches to the rail 54*b* at a point 58*b*.

Figure 4:
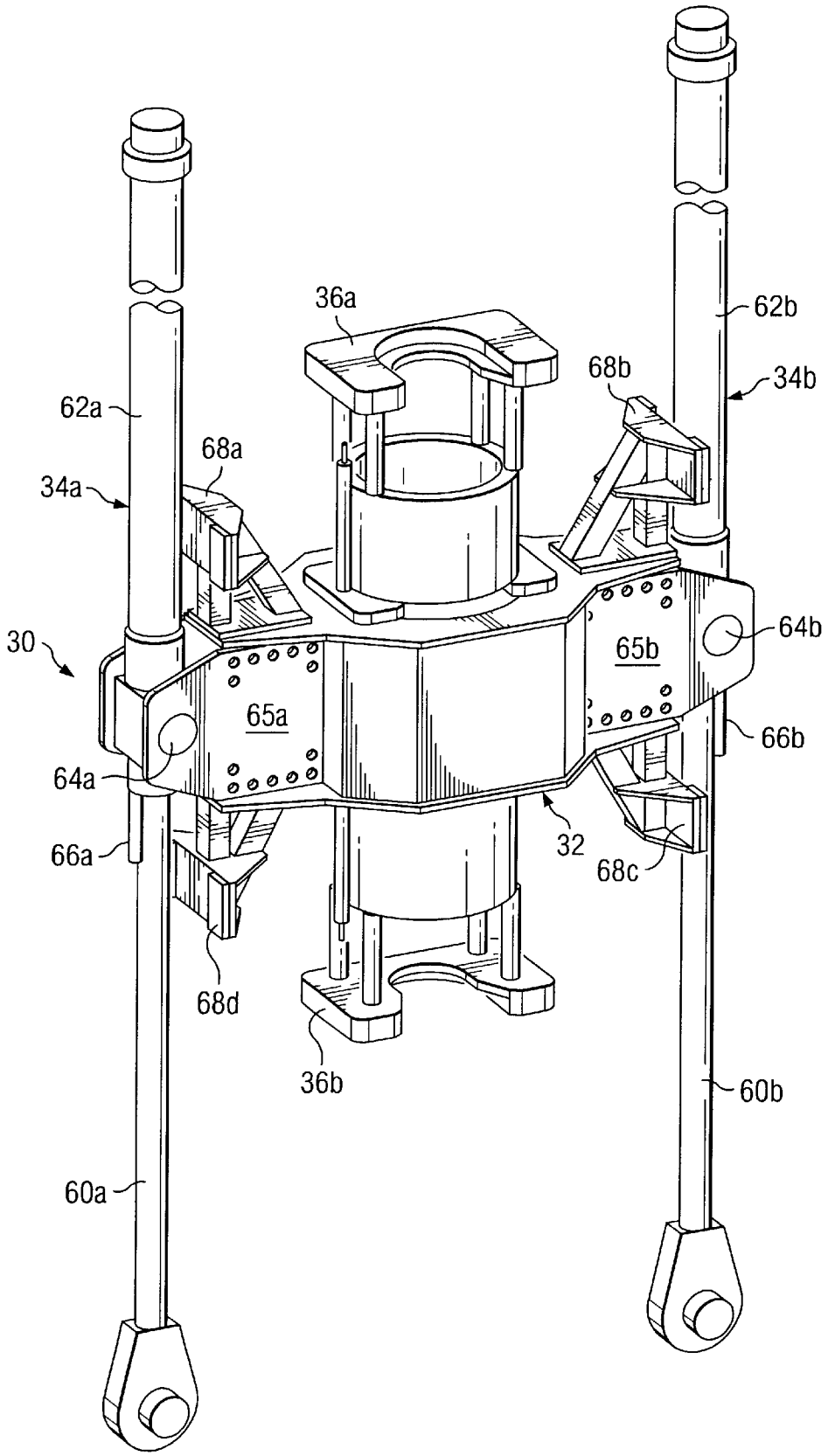
FIG. 4 is an enlarged isometric view of another portion of the system of FIG. 1.

Referring to FIG. 4 of the drawings, the hydraulic cylinders 34*a* and 34*b* of the lower jack 30 also extend vertically as viewed in the drawing, and include two rods 60*a* and 60*b*, respectively, which move between a retracted and extended portion relative to two barrels 62*a* and 62*b*, respectively, in a conventional manner. The respective lower ends of the barrels 62*a* and 62*b* are connected to two tabs 64*a* and 64*b*, respectively, which are mounted between two sets of flanges 65*a* and 65*b*, respectively, on opposing sides of the traveling head 32 to allow rotational movement between the traveling head 32 and the hydraulic cylinders 34*a* and 34*b*, respectively.

Linear position transducers 66*a* and 66*b* are attached to the hydraulic cylinders 34*a* and 34*b*, respectively, for detecting and tracking the position of the lower jack 30. The use of the linear position transducers 66*a* and 66*b* will be described in additional detail below. The traveling head 32 includes guides 68*a* and 68*b* mounted on an upper portion of the traveling head 32 and guides 68*c* and 68*d* mounted on a lower portion of the traveling head 32. The function of the guides 68*a*, 68*b*, 68*c* and 68*d* will be described in additional detail below.

Figure 5:
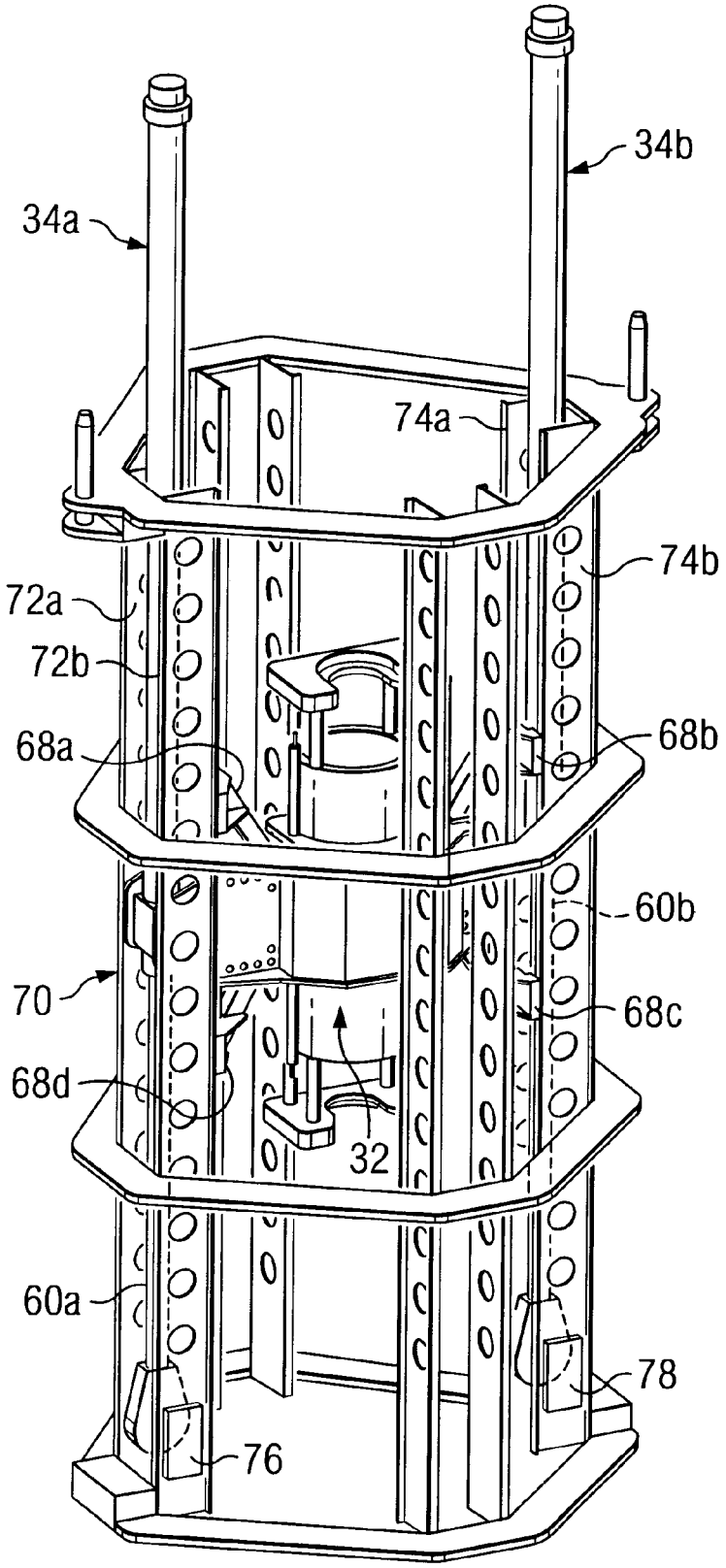
FIG. 5 is an isometric view of the portion of FIG. 4 shown located in the lower section of the tower.

FIG. 5 depicts the lower jack 30 located in a lower tower section 70 which is formed by a plurality of vertical and horizontal structural members in a conventional manner. The lower tower section 70 includes two vertically spaced, opposed rails 72*a* and 72*b* as well as two vertically spaced, opposed rails 74*a* and 74*b* spaced from the rails 72*a* and 72*b*. Each of the guides 68*a* and 68*d* of the lower jack 30 extend between the rails 72*a* and 72*b* in engagement therewith; and each of the guides 68*b* and 68*c* extend between the rails 74*a* and 74*b*, in engagement therewith to permit vertical movement of the traveling head 32 relative to the lower tower section 70.

The hydraulic cylinder 34*a* is mounted between the rails 72*a* and 72*b* and is attached between the rails 72*a* and 72*b* at a point 76, and the hydraulic cylinder 34*b* is mounted between the rails 74*a* and 74*b* and is attached to the rails 74*a* and 74*b* at a point 78 in a conventional manner.

Figure 6:
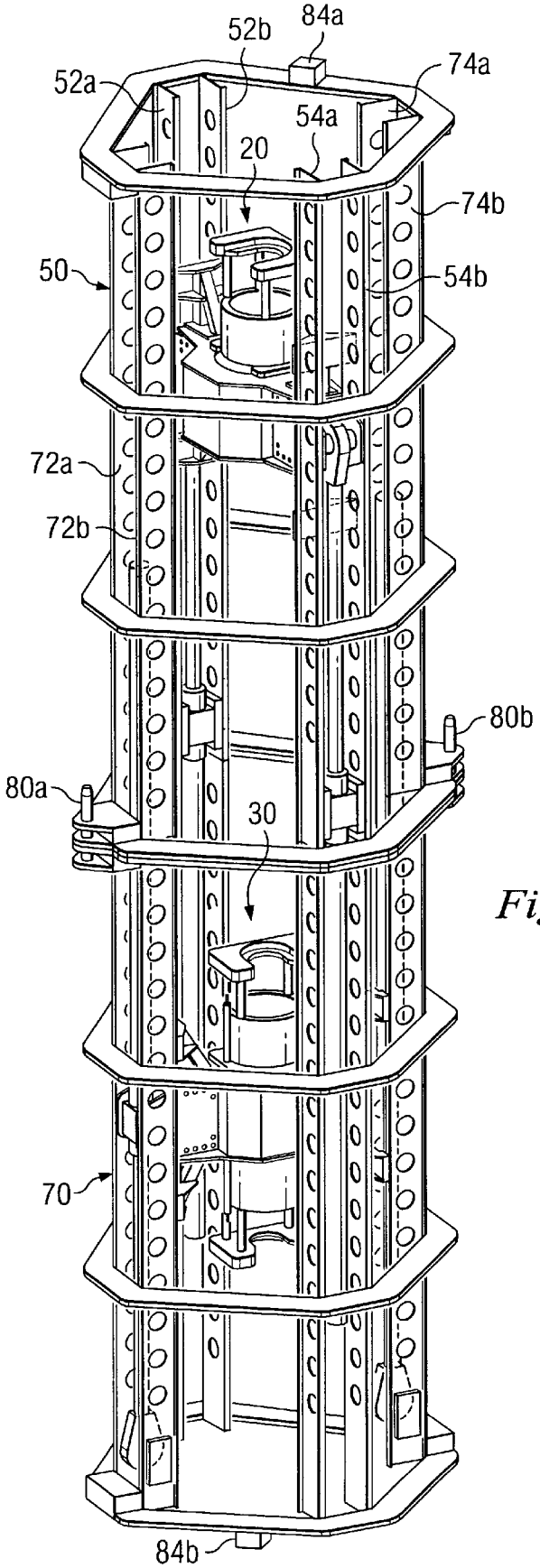
FIG. 6 is an isometric view of the system of FIG. 1 located in the tower.

Referring to FIG. 6, the upper tower section 50 is stacked over, and is connected to, the lower tower section 70 using pins 80*a* and 80*b*, thus constructing a tower. The rails 52*a* and 52*b* and the rails 54*a* and 54*b* extend through the lower tower section 70 for guiding the upper jack 20 through the tower and the rails 72*a* and 72*b* and the rails 74*a* and 74*b* extend through the upper tower section 50 for guiding the lower jack 30 through the tower.

Two tool joint sensors 84*a* and 84*b* are located above and below the upper jack 20 and the lower jack 30, respectively. The tool joint sensors 84*a* and 84*b* detect the presence of a tool joint attached to a pipe string entering either the upper jack 20 or the lower jack 30. The function of the tool joints sensors 84*a* and 84*b* will be described in additional detail below.

Figure 7:
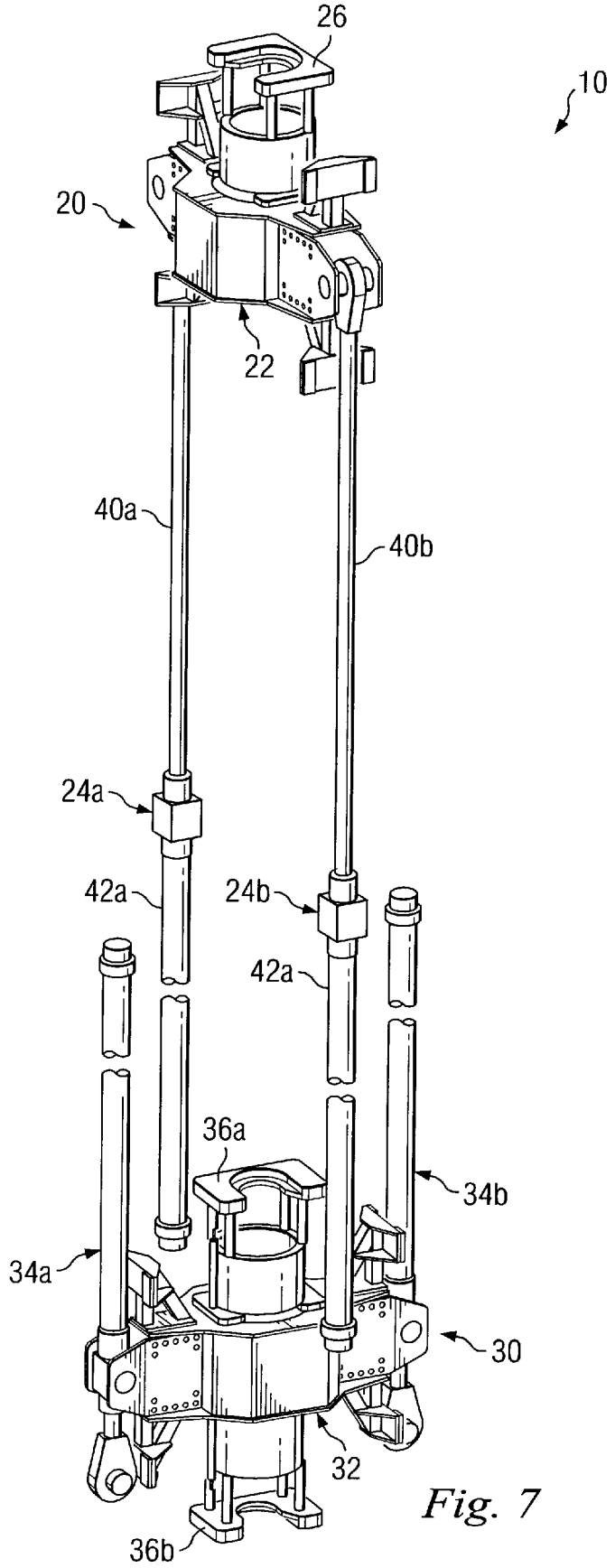
FIG. 7 is an isometric view of the system of FIG. 1 in a second operational mode.

Referring to FIG. 7, the hydraulic cylinders 24*a* and 24*b* of the upper jack 20 are shown in a fully extended position, and the hydraulic cylinders 34*a* and 34*b* of the lower jack 30 are shown in a fully retracted position such that the head 22 is at a maximum distance from the traveling head 32.

Figure 8:
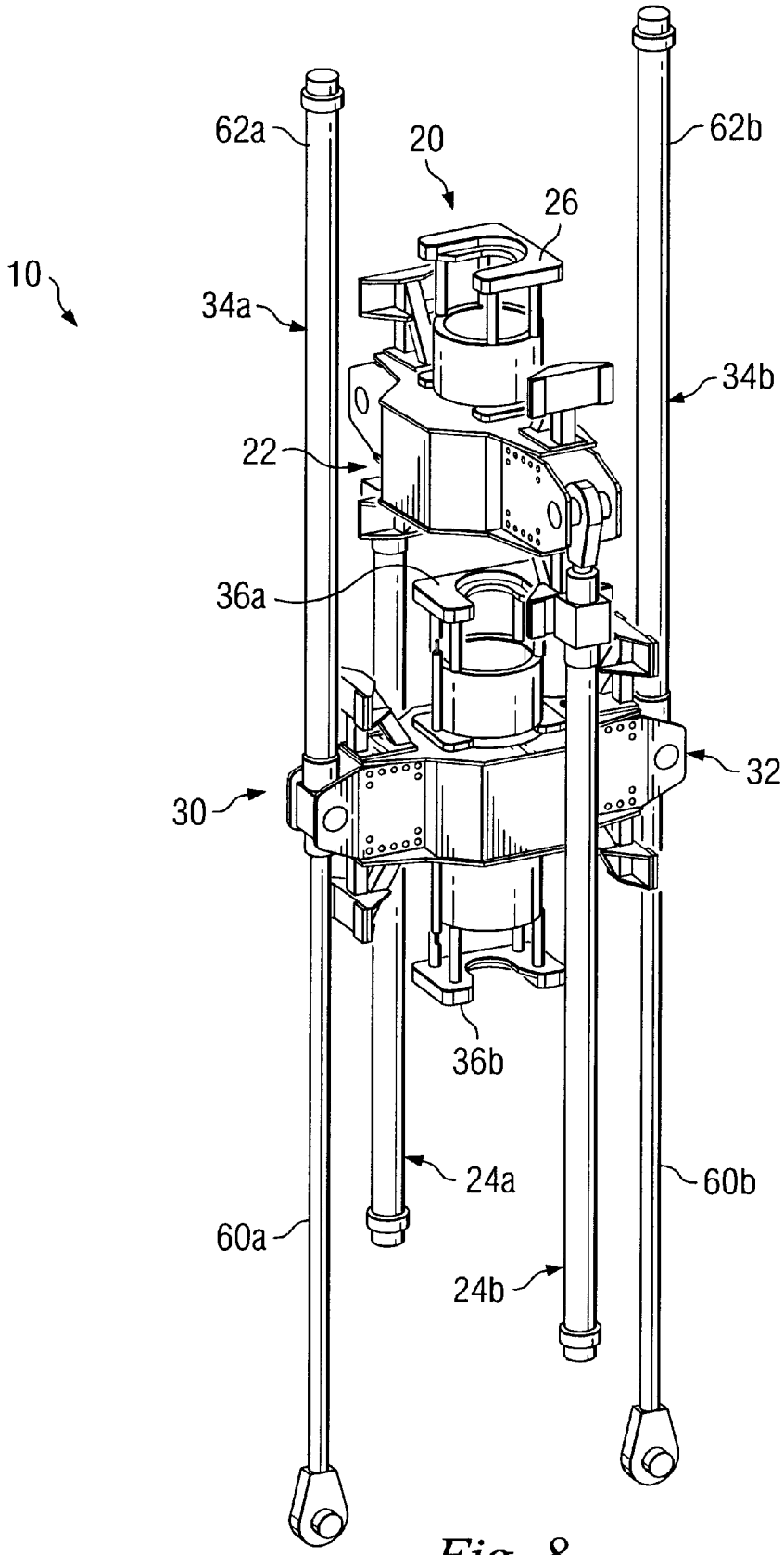
FIG. 8 is an isometric view of the system of FIG. 1 in a third operational mode.

Referring to FIG. 8, the hydraulic cylinders 24*a* and 24*b* of the upper jack 20 are shown in a fully retracted position, and the hydraulic cylinders 34*a* and 34*b* of the lower jack 30 are shown in a fully extended position such that the head 22 is at a minimum distance from the traveling head 32.

In operation, the system 10 inserts and extracts jointed tubulars or continuous coiled tubing into and out of a well such as an oil well or a gas well at a relatively high rate of speed. The system 10 may be operated in two modes: a high speed mode and a low speed mode. These modes of operation will be described below with reference to FIG. 1, FIG. 7, and FIG. 8.

In the high speed mode of operation, the upper jack 20 and the lower jack 30 move in opposing directions. In this mode, the hydraulic cylinders 24*a* and 24*b* of the upper jack 20 move to their full extension at the same time the hydraulic cylinders 34*a* and 34*b* of the lower jack 30 move to their full retraction, as shown in FIG. 7. In this mode, the hydraulic cylinders 24*a* and 24*b* of the upper jack 20 also move to their full retraction at the same time the hydraulic cylinders 34*a* and 34*b* of the lower jack 30 move to their full extension as shown in FIG. 8.

The operation of the system 10 may vary according to the pressure of a oil or gas well. In particular, the operation may depend on whether the system 10 is operating under pipe heavy conditions or pipe light conditions. Pipe heavy conditions occur where the downward force caused by the weight of the tubulars equals or exceeds the upward force caused by pressure in the well. Pipe light conditions occur where the downward force caused by the weight of the tubulars is less than the upward force caused by pressure in the well. Operation of system 10 in the high and low speed modes of operation will now be described under pipe heavy conditions.

To insert tubulars into a well in the high speed mode under pipe heavy conditions, the slip bowl 26 of the upper jack 20 engages a tubular in the position shown in FIG. 7. The slip bowls 36*a* and 36*b* of the lower jack 30 remain disengaged in this position. The hydraulic cylinders 24*a* and 24*b* of the upper jack 20 then move to their full retraction at the same time the hydraulic cylinders 34*a* and 34*b* of the lower jack 30 move to their full extension to reach the respective positions shown in FIG. 8. In these positions, the slip bowl 36*a* of the lower jack 30 engages the tubulars and the slip bowl 26 of the upper jack 20 disengages the tubulars. The hydraulic cylinders 24*a* and 24*b* of the upper jack 20 then move to their full extension at the same time the hydraulic cylinders 34*a* and 34*b* of the lower jack 30 move to their full retraction as shown in FIG. 7 to effectively lower the tubulars into the well. The process just described is repeated to continue lowering the tubulars into the well.

To extract tubulars from a well in the high speed mode under pipe heavy conditions, the slip bowl 36*a* of the lower jack 30 engages the tubulars in the position shown in FIG. 7. The slip bowl 26 of the upper jack 20 remains disengaged in this position. The hydraulic cylinders 24*a* and 24*b* of the upper jack 20 then move to their full retraction at the same time the hydraulic cylinders 34*a* and 34*b* of the lower jack 30 move to their full extension to reach the respective positions shown in FIG. 8. In these positions, the slip bowl 36*a* of the lower jack 30 disengages the tubulars and the slip bowl 26 of the upper jack 20 engages the tubulars. The hydraulic cylinders 24*a* and 24*b* of the upper jack 20 then move to their full extension at the same time the hydraulic cylinders 34*a* and 34*b* of the lower jack 30 move to their full retraction as shown in FIG. 7 to effectively raise the tubulars from the well. The process just described is repeated to continue raising the tubulars from the well.

In the low speed mode of operation under pipe heavy conditions, the upper jack 20 and the lower jack 30 move in the same direction and each carry a portion of the tubular load. In this mode, the hydraulic cylinders 24*a* and 24*b* of the upperjack 20 move to their full extension at the same time the hydraulic cylinders 34*a* and 34*b* of the lower jack 30 move to their full extension. The upper jack 20 is shown in this position in FIG. 7, and the lower jack 30 is shown in this position in FIG. 8. The hydraulic cylinders 24*a* and 24*b* of the upper jack 20 also move to their full retraction at the same time the hydraulic cylinders 34*a* and 34*b* of the lower jack 30 move to their full retraction. The upper jack 20 and the lower jack 30 are shown in these respective positions in FIG. 1.

Figure 9:
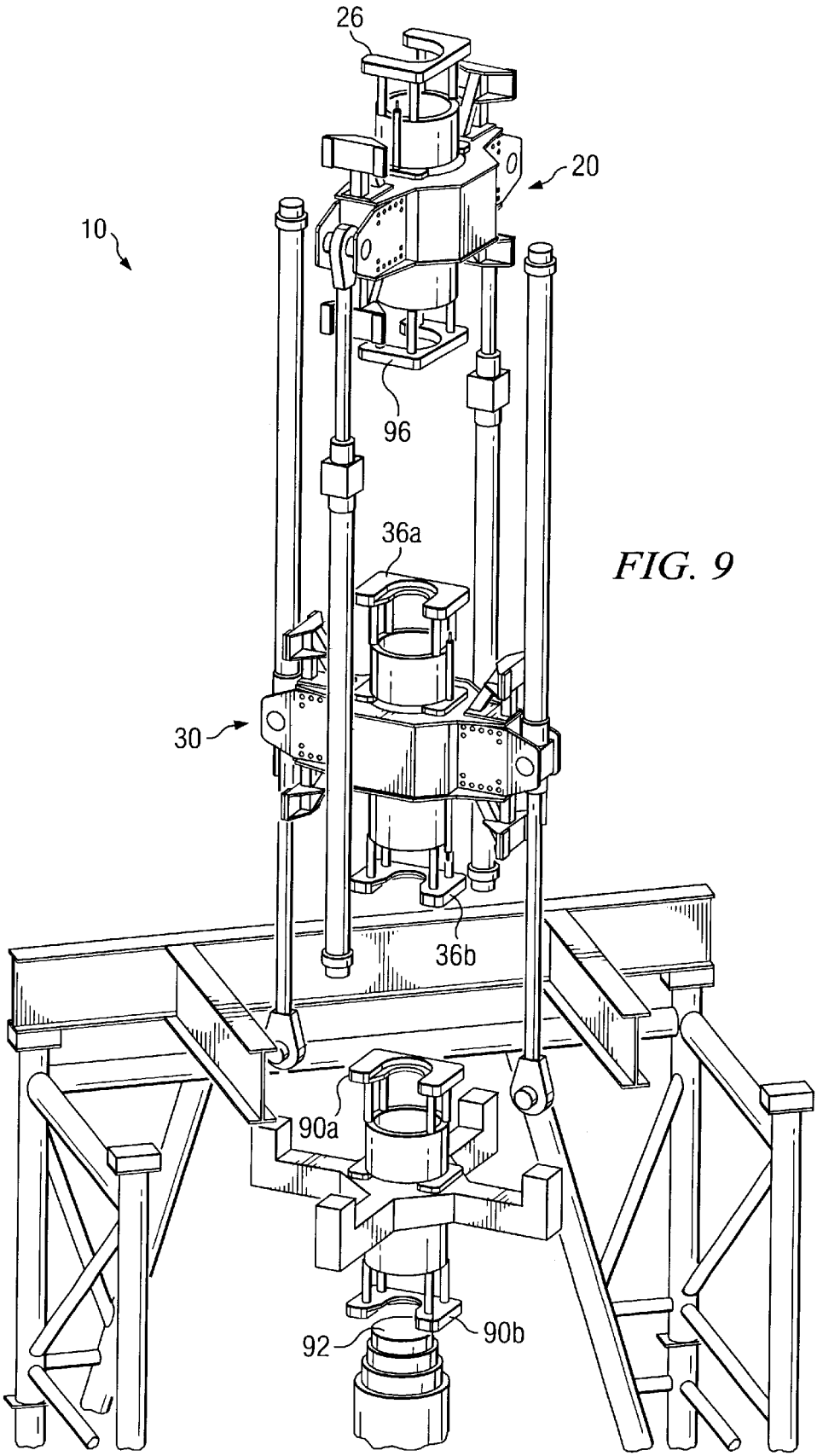
FIG. 9 is an isometric view of the embodiment of FIG. 1 extending over a wellhead.

Referring to FIG. 9, a stationary slip bowl 90*a* and an inverted stationary slip bowl 90*b* is mounted over a wellhead 92. The stationary slip bowl 90*a* is used in the low speed mode of operation under pipe heavy conditions, and it will be assumed that it engages the upper tubular of the tubulars to be extracted from the wellhead.

To extract tubulars from the well in the low speed mode under pipe heavy conditions, the slip bowl 26 of the upper jack 20 and the slip bowl 36*a* of the lower jack 30 engage the tubulars when the hydraulic cylinders 24*a* and 24*b* of the upper jack 20 and the hydraulic cylinders 34*a* and 34*b* of the lower jack 30 are in the fully retracted position as shown in FIG. 1. The stationary slip bowl 90*a* then disengages the tubulars. The hydraulic cylinders 24*a* and 24*b* of the upper jack 20 and the hydraulic cylinders 34*a* and 34*b* of the lower jack 30 then move to their fully extended position at the same time to effectively raise the tubulars out of the well. Once in these positions, the stationary slip bowl 90*a* engages the tubulars, and the slip bowls 26 and 36*a* disengage the tubulars. The hydraulic cylinders 24*a*, 24*b*, 34*a*, and 34*b* then move to their fully retracted position at the same time to repeat the process.

To insert tubulars into a well in the low speed mode under pipe heavy conditions, the slip bowl 26 of the upper jack 20 and the slip bowl 36*a* of the lower jack 30 engage the tubulars when the hydraulic cylinders 24*a* and 24*b* of the upper jack 20 and the hydraulic cylinders 34*a* and 34*b* of the lower jack 30 are in the fully extended position as shown in FIG. 7 with respect to the cylinders 24*a* and 24*b*, and in FIG. 8 with respect to the cylinders 34*a* and 34*b*. The stationary slip bowl 90*a* then disengages the tubulars, and the hydraulic cylinders 24*a* and 24*b* of the upper jack 20 and the hydraulic cylinders 34*a* and 34*b* of the lower jack 30 are moved to their fully retracted position at the same time as shown in FIG. 1 to lower the tubulars into the well. Once in these positions, the stationary slip bowl 90*a* engages the tubulars, and the slip bowls 26 and 36*a* disengage the tubulars. The hydraulic cylinders 24*a*, 24*b*, 34*a*, and 34*b* then move to their fully extended position at the same time and the cycle is repeated.

Although the low speed mode of operation under pipe heavy conditions is described above as using both the upper jack 20 and the lower jack 30, tubulars may be inserted or extracted in the low speed mode using only one of the upper jack 20 or the lower jack 30. For example, if only the upper jack 20 is used, system 10 will operate in the low speed mode as described above with the exception that the lower jack 30 will not move and the slip bowl 36*a* of the lower jack 30 will not engage the tubulars. Likewise, if only the lower jack 30 is used, system 10 will operate in the low speed mode as described above with the exception that the upper jack 30 will not move and the slip bowl 26 of the upper jack 20 will not engage the tubulars.

Operation of system 10 in the high and low speed modes of operation will now be described under pipe light conditions.

To insert tubulars into a well in the high speed mode under pipe light conditions, the head 22 of the upper jack 20 includes an additional engaging and disengaging unit, in the form of an inverted slip bowl 96 shown in FIG. 9, adapted to engage and release a tubular (not shown). The inverted slip bowl 96 of the upper jack 20 engages a tubular in the position shown in FIG. 7. The slip bowls 36*a* and 36*b* of the lower jack 30 remain disengaged in this position. The hydraulic cylinders 24*a* and 24*b* of the upper jack 20 then move to their full retraction at the same time the hydraulic cylinders 34*a* and 34*b* of the lower jack 30 move to their full extension to reach the respective positions shown in FIG. 8. In these positions, the inverted slip bowl 36*b* of the lower jack 30 engages the tubulars and the inverted slip bowl 96 of the upper jack 20 disengages the tubulars. The hydraulic cylinders 24*a* and 24*b* of the upper jack 20 then move to their full extension at the same time the hydraulic cylinders 34*a* and 34*b* of the lower jack 30 move to their full retraction as shown in FIG. 7 to effectively lower the tubulars into the well. The process just described is repeated to continue lowering the tubulars into the well.

To extract tubulars from a well in the high speed mode under pipe light conditions, the inverted slip bowl 36*b* of the lower jack 30 engages the tubulars in the position shown in FIG. 7. The inverted slip bowl 96 of the upper jack 20 remains disengaged in this position. The hydraulic cylinders 24*a* and 24*b* of the upper jack 20 then move to their full retraction at the same time the hydraulic cylinders 34*a* and 34*b* of the lower jack 30 move to their full extension to reach the respective positions shown in FIG. 8. In these positions, the inverted slip bowl 36*b* of the lower jack 30 disengages the tubulars and the inverted slip bowl 96 of the upper jack 20 engages the tubulars. The hydraulic cylinders 24*a* and 24*b* of the upper jack 20 then move to their full extension at the same time the hydraulic cylinders 34*a* and 34*b* of the lower jack 30 move to their full retraction as shown in FIG. 7 to effectively raise the tubulars from the well. The process just described is repeated to continue raising the tubulars from the well.

Referring to FIG. 9, the inverted stationary slip bowl 90*b* is used in the low speed mode of operation under pipe light conditions, and it will be assumed that it engages the upper tubular of the tubulars to be extracted from the wellhead.

To extract tubulars from the well in the low speed mode under pipe light conditions, the inverted slip bowl 96 of the upper jack 20 and the inverted slip bowl 36*b* of the lower jack 30 engage the tubulars when the hydraulic cylinders 24*a* and 24*b* of the upper jack 20 and the hydraulic cylinders 34*a* and 34*b* of the lower jack 30 are in the fully retracted position as shown in FIG. 1. The inverted stationary slip bowl 90*b* then disengages the tubulars. The hydraulic cylinders 24*a* and 24*b* of the upper jack 20 and the hydraulic cylinders 34*a* and 34*b* of the lower jack 30 then move to their fully extended position at the same time to effectively raise the tubulars out of the well. Once in these positions, the inverted stationary slip bowl 90*b* engages the tubulars, and the inverted slip bowls 96 and 36*b* disengage the tubulars. The hydraulic cylinders 24*a*, 24*b*, 34*a*, and 34*b* then move to their fully retracted position at the same time to repeat the process.

To insert tubulars into a well in the low speed mode under pipe light conditions, the inverted slip bowl 96 of the upper jack 20 and the inverted slip bowl 36*b* of the lower jack 30 engage the tubulars when the hydraulic cylinders 24*a* and 24*b* of the upper jack 20 and the hydraulic cylinders 34*a* and 34*b* of the lower jack 30 are in the fully extended position as shown in FIG. 7 with respect to the cylinders 24*a* and 24*b*, and in FIG. 8 with respect to the cylinders 34*a* and 34*b*. The inverted stationary slip bowl 90*b* then disengages the tubulars, and the hydraulic cylinders 24*a* and 24*b* of the upper jack 20 and the hydraulic cylinders 34*a* and 34*b* of the lower jack 30 are moved to their fully retracted position at the same time as shown in FIG. 1 to lower the tubulars into the well. Once in these positions, the inverted stationary slip bowl 90*b* engages the tubulars, and the inverted slip bowls 96 and 36*b* disengage the tubulars. The hydraulic cylinders 24*a*, 24*b*, 34*a*, and 34*b* then move to their fully extended position at the same time and the cycle is repeated.

Although the low speed mode of operation under pipe light conditions is described above as using both the upper jack 20 and the lower jack 30, tubulars may be inserted or extracted in the low speed mode using only one of the upper jack 20 or the lower jack 30. For example, if only the upper jack 20 is used, system 10 will operate in the low speed mode as described above with the exception that the lower jack 30 will not move and the inverted slip bowl 36*b* of the lower jack 30 will not engage the tubulars. Likewise, if only the lower jack 30 is used, system 10 will operate in the low speed mode as described above with the exception that the upper jack 30 will not move and the inverted slip bowl 96 of the upper jack 20 will not engage the tubulars.

Figure 10:
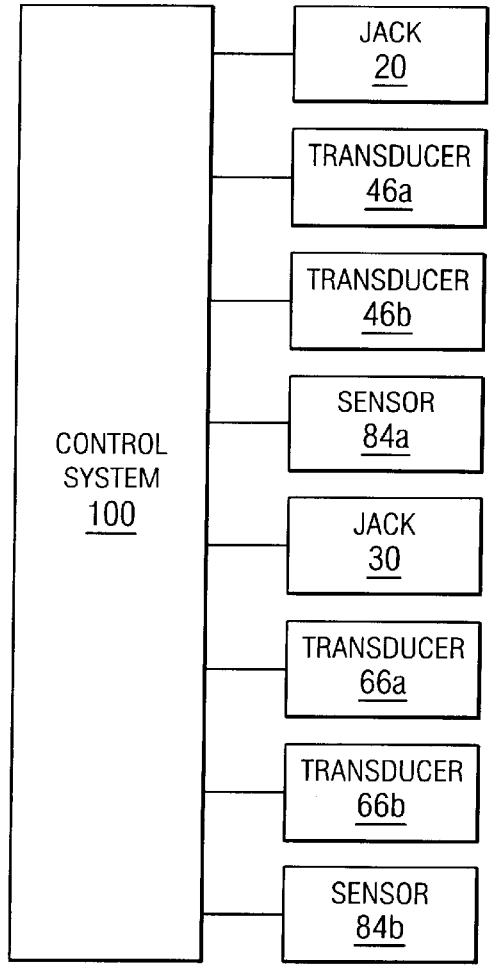
FIG. 10 is a diagram illustrating an embodiment of a control system associated with the system of FIG. 1.

Referring to FIG. 10 of the drawings, the operation of the system 10 in the high speed mode and the low speed mode is monitored and controlled by a computerized control system 100. The control system 100 couples to the upper jack 20, the lower jack 30, the transducers 46*a*, 46*b*, 66*a*, and 66*b*, and the sensors 84*a* and 84*b* using any suitable wired or wireless connection or connections. The control system 100 is also coupled to slip bowls 26, 36*a*, 36*b*, 90*a*, and 90*b* and causes the slip bowls 26, 36*a*, 36*b*, 90*a*, and 90*b* to engage or disengage tubulars. The control system 100 may be located on the upper tower section 50 or the lower tower section 70 or another structure that includes the system 10 or may be located remotely from such a tower or structure.

An operator of the system 10 selects either the high speed mode or the low speed mode and either to raise tubulars from a well or to lower tubulars into a well using the control system 100. The control system 100 provides signals to the upper jack 20 and the lower jack 30 to control the movement of the upper jack 20 and the lower jack 30 in the manner described above according to the selections by the operator.

The control system 100 controls and monitors the position and speed of the upper jack 20 and the lower jack 30 according to position information received from the transducers 46*a*, 46*b*, 66*a*, and 66*b* shown in FIG. 2 and FIG. 4. The transducers 46*a*, 46*b*, 66*a*, and 66*b* provide the control system 100 with position information regarding the positions of the upper jack 20 and the lower jack 30, respectively. The control system 100 processes the position information to determine the speed and the locations of the upper jack 20 and the lower jack 30.

The tool joint sensors 84*a* and 84*b*, shown in FIG. 6, detect the presence of a tool joint attached to a pipe string entering either the upper jack 20 or the lower jack 30 and send detection information to the control system 100. The control system 100 uses the detection information to track the position of a tool joint as the tool joint moves within the system 10. The control system 100 automatically adjusts the position of the slip bowls 26, 36*a*, and 36*b* relative to the tool joint to prevent the slip bowls 26, 36*a*, and 36*b* from engaging and possibly damaging the tool joint.

ALTERNATIVE EMBODIMENTS

In an alternative embodiment not shown, the hydraulic cylinders 34*a* and 34*b* may be inverted such that the rods 60*a* and 60*b* extend in an upward direction from the barrels 62*a* and 62*b*. In this example, the rods 60*a* and 60*b* attach to the traveling head 32 similar to the way the rods 40*a* and 40*b* attach to the head 22.

In addition, other embodiments are possible by inverting the cylinders and/or changing the mounting of the cylinder barrels and rod ends.

It is understood that variations may be made in the above without departing from the scope of the invention. For example, mechanisms other than jacks and hydraulic cylinders can be used to reciprocate the slip bowls. Also, the slip bowls may be replaced by other units for engaging and disengaging the tubulars. Further, when the expression "tubular" is used it is meant to cover any type of tubular member such as coiled tubing, conduits, pipes, pipe joints, hoses, etc., and the reference to "tubular" in the singular does not preclude inclusion of a plurality of tubulars in the same string.

Although only a few exemplary embodiments of this invention have been described in detail above, those skilled in the art will readily appreciate that many other variations and modifications are possible in the exemplary embodiments without materially departing from the novel teachings and advantages of this invention. Accordingly, all such modifications are intended to be included within the scope of this invention as defined in the following claims.

What is claimed is:

1. A method for raising a plurality of tubulars into a well comprising the steps of:

engaging one of the plurality of tubulars with a first slip bowl attached to a first jack;

engaging the one of the plurality of tubulars with a second slip bowl attached to a second jack;

extending the first jack and the second jack substantially simultaneously to raise the plurality of tubulars subsequent to engaging the one of the plurality of tubulars with the first slip bowl and the second slip bowl;

engaging the one of the plurality of tubulars with a third slip bowl not attached to the first jack or the second jack subsequent to extending the first jack and the second jack;

disengaging the one of the plurality of tubulars with the first slip bowl and the second slip bowl subsequent to engaging the one of the plurality of tubulars with the third slip bowl; and retracting the first jack and the second jack subsequent to disengaging the one of the plurality of tubulars with the first slip bowl and the second slip bowl.

2. The method of claim 1, further comprising the step of disengaging the one of the plurality of tubulars with the third slip bowl subsequent to engaging the one of the plurality of tubulars with the first slip bowl and the second slip bowl and prior to extending the first jack and the second jack.

3. A method for lowering a plurality of tubulars into a well comprising the steps of:

engaging one of the plurality of tubulars with a first slip bowl attached to a first jack;

engaging the one of the plurality of tubulars with a second slip bowl attached to a second jack;

retracting the first jack and the second jack substantially simultaneously to lower the plurality of tubulars subsequent to engaging the one of the plurality of tubulars with the first slip bowl and the second slip bowl;

engaging the one of the plurality of tubulars with a third slip bowl not attached to the first jack or the second jack subsequent to retracting the first jack and the second jack;

disengaging the one of the plurality of tubulars with the first slip bowl and the second slip bowl subsequent to engaging the one of the plurality of tubulars with the third slip bowl; and extending the first jack and the second jack subsequent to disengaging the one of the plurality of tubulars with the first slip bowl and the second slip bowl.

4. The method of claim 3, further comprising the step of disengaging the one of the plurality of tubulars with the third slip bowl subsequent to engaging the one of the plurality of tubulars with the first slip bowl and the second slip bowl and prior to retracting the first jack and the second jack.

5. A system for moving a tubular member in a tower, the system comprising:

a first jack assembly connected to the tower and adapted to expand and contract;

a first engaging unit supported on the first jack assembly and adapted to engage and release the tubular member;

a second jack assembly connected to the tower and adapted to expand and contract;

a second engaging unit supported on the second jack assembly and adapted to engage and release the tubular member; and a control unit for moving the first jack assembly from an expanded position to a retracted position with the first engaging unit engaging the tubular while moving the second jack assembly from a retracted position to an expanded position so that the second engaging unit can engage the tubular.

6. The system of claim 5, wherein the control unit also moves the first jack assembly from the retracted position to the expanded position and moves the second jack assembly from the expanded position to the retracted position with the second engaging unit engaging the tubular.

7. The system of claim 5, wherein each jack assembly comprises a head, and at least one hydraulic cylinder attached to opposing sides of the head.

8. The system of claim 7, wherein there are two hydraulic cylinders attached to opposing sides of the head.

9. The system of claim 7, further comprising a guide attached to each jack assembly for guiding the head along the tower.

10. The system of claim 5, further comprising a position transducer mounted on each jack assembly for providing position information associated with jack assemblies to the control unit.

11. A system for moving a tubular member in a tower, the system comprising:

a first jack assembly connected to the tower and adapted to expand and contract;

a first engaging unit supported on the first jack assembly and adapted to engage and release the tubular member;

a second jack assembly connected to the tower and adapted to expand and contract;

a second engaging unit supported on the second jack assembly and adapted to engage and release the tubular member; and a control unit for moving each jack assembly from an expanded position to a retracted position at the same time with both engaging units engaging the tubular to move the tubular in the tower.

12. The system of claim 11 wherein the control unit moves each jack assembly from the retracted position to the expanded position at the same time so that the engaging units can engage the tubular.

13. The system of claim 11, wherein each jack assembly comprises a head, and at least one hydraulic cylinder attached to opposing sides of the head.

14. The system of claim 13, wherein there are two hydraulic cylinders attached to opposing sides of the head.

15. The system of claim 11, further comprising a guide attached to each jack assembly for guiding the head along the tower.

16. The system of claim 11, further comprising a position transducer mounted on each jack assembly for providing position information associated with jack assemblies to the control unit.

17. A method for moving a tubular member in a tower, the method comprising:

supporting a first engaging unit on a first jack assembly;

connecting the first jack assembly to the tower so that the first jack assembly can expand and contract;

supporting a second engaging unit on a second jack assembly;

connecting the second jack assembly to the tower so that the second jack assembly can expand and contract; and moving the first jack assembly from an expanded position to a retracted position with the first engaging unit engaging the tubular while moving the second jack assembly from a retracted position to an expanded position so that the second engaging unit can engage the tubular.

18. The method of claim 17 further comprising moving the first jack assembly from the retracted position to the expanded position and moving the second jack assembly from the expanded position to the retracted position with the second engaging unit engaging the tubular.

19. The method of claim 17, further comprising guiding the head along the tower.

20. The method of claim 17, further comprising providing position information associated with the jack assemblies to the control unit.

21. A method for moving a tubular member in a tower, the method comprising:

supporting a first engaging unit on a first jack assembly;

connecting the first jack assembly to the tower so that the first jack assembly can expand and contract;

supporting a second engaging unit on a second jack assembly;

connecting the second jack assembly to the tower so that the second jack assembly can expand and contract; and moving each jack assembly from an expanded position to a retracted position at the same time with both engaging units engaging the tubular to move the tubular in the tower.

22. The method of claim 21 further comprising moving each assembly from the retracted position to the expanded position at the same time so that the engaging units can engage the tubular.

23. The method of claim 21, further comprising guiding the head along the tower.

24. The method of claim 21, further comprising providing position information associated with the jack assemblies to the control unit.

* * * * *